US010219070B2

(12) United States Patent
Chyzhov

(10) Patent No.: US 10,219,070 B2
(45) Date of Patent: Feb. 26, 2019

(54) ACOUSTIC SYSTEM AND METHOD

(71) Applicant: Maksim Viktorovich Chyzhov, Odessa (UA)

(72) Inventor: Maksim Viktorovich Chyzhov, Odessa (UA)

( * ) Notice: Subject to any disclaimer, the term of this patent is extended or adjusted under 35 U.S.C. 154(b) by 91 days.

(21) Appl. No.: 15/350,321

(22) Filed: Nov. 14, 2016

(65) Prior Publication Data

US 2017/0070806 A1 Mar. 9, 2017

Related U.S. Application Data

(63) Continuation-in-part of application No. 14/622,980, filed on Feb. 16, 2015.

(30) Foreign Application Priority Data

Feb. 24, 2014 (UA) ..... 201401715 U

(51) Int. Cl.
*H04R 1/28* (2006.01)

(52) U.S. Cl.
CPC ..... *H04R 1/288* (2013.01); *H04R 1/2888* (2013.01); *H04R 2201/029* (2013.01)

(58) Field of Classification Search
CPC ..... H04R 1/2803; H04R 1/02; H04R 1/28; H04R 1/288; H04R 1/2888; H04R 2201/029
USPC ..... 381/345, 346, 386, 332, 337, 349, 87, 381/353
See application file for complete search history.

(56) References Cited

U.S. PATENT DOCUMENTS

2014/0037119 A1* 2/2014 Yuasa ..... H04R 1/02 381/346

FOREIGN PATENT DOCUMENTS

| | | | |
|---|---|---|---|
| CN | 101711004 A | * | 5/2010 |
| CN | 201541336 U | * | 8/2010 |
| CN | 201541336 U | * | 8/2010 |
| CN | 101711004 B | * | 4/2013 |
| CN | 203661268 U | * | 6/2014 |
| CN | 203661268 U | * | 6/2014 |

* cited by examiner

*Primary Examiner* — Akelaw Teshale
(74) *Attorney, Agent, or Firm* — Nadya Reingand; Yan Hankin

(57) ABSTRACT

Invention relates to the field of acoustic systems used to convert electrical signal into sound, and the design of the housing where the electroacoustic loudspeaker is mounted and may be used in household and industrial applications as an acoustic system. The acoustic transducer has a housing, made from coconut endocarp, containing at least one opening for mounting a loudspeaker, and can have additional openings for wires and/or connectors to the signal source, sound-absorbing or dampening materials, mounting elements, for example, hooks for mounting with use of a flexible cord or any other similar fastening elements, connectors, phase inverter, electronics unit, protective decorative mesh or cloth. The proposed acoustic system provides improved sound quality by reducing the level of parasitic acoustic resonances, excited by the loudspeaker in the housing during sound generation by the loudspeaker's membrane.

20 Claims, 7 Drawing Sheets

ACOUSTIC SYSTEM AND METHOD

CROSS REFERENCE AND RELATED APPLICATION DATA

The current patent application is Continuation-in-Part of U.S. patent application Ser. No. 14/622,980 filed on Feb. 16, 2015 and claims priority to Ukranian application No. u2014 01715 filed on Feb. 24, 2014.

FIELD OF THE INVENTION

The invention relates to the field of acoustic systems designed for converting electrical signals into sound, namely, to the design of the housing where the electroacoustic transducer (loudspeaker) is mounted within, which ma be used in household and industrial applications as an acoustic system.

BACKGROUND OF THE INVENTION

From prior art related to the analyzed field, the closest analog by a set of features to the claimed invention is an acoustic system comprising a housing, wherein the inner surface does not contain ribs, which is made a continuous round body—spheroid, ovaloid, or ellipsoid of revolution, such that the inside surface of the housing, defining the empty volume inside, closely matches the outside surface, while the inner volume is connected to the external environment by openings where, at the least, one of which serves as a mount for the loudspeaker, moreover the housing is made from isotropic material obtained from a mixture of hardened synthetic cohesion material and solid mineral fillers (EP 1220568A2 MKP: H04R 1/28, publ. 29 Dec. 2000).

The claimed invention matches a known acoustic system along the following set of essential features, namely, including a housing implemented as a three-dimensional body, such that the outer surface does not have ribs and the inner volume contains a cavity with surface equidistant from the outer surface and contains a minimum of one opening.

However, the known acoustic system does not provide the technical results of the claimed invention, which is due to the properties of the material from which it is prepared—a mixture of hardened synthetic cohesion material and solid mineral fillers, which have isotropic properties that are characterized by identical mechanical properties, such as hardness, in all directions, and the use of large mass and dimensions of this type of design for eliminating parasitic acoustic resonances generated from the side of the loudspeaker, which is mounted in the housing,

SUMMARY OF THE INVENTION

The objective, which the claimed invention aims to solve is to improve the design of the acoustic system by changing and further processing the material used to make the housing. The material used to make the housing is changed from an isotropic to an orthotropic material, which, in combination with further processing of the housing, improves the quality of the acoustic signal by lowering levels of parasitic acoustic resonances. Simultaneously, this invention decreases housing surface pulsation, which is excited by the electroacoustic transducer (loudspeaker) in the housing at the same time as the useful signal is generated by the loudspeaker membrane. Furthermore, the present invention at the same time decreases the housing mass and size.

In general, orthotropic materials have different material properties along each axis. Some examples of orthotropic materials include but are not limited to wood, coconut endocarp, and metal rolled into sheet form. The present invention addresses implementation of the coconut endocarp of a particular geometry and size as a housing of an acoustic system.

The stated objective is achieved in the presently described system and method, which comprises a housing implemented as a three-dimensional body, such that the outer surface does not have ribs and inner volume contains a cavity with surface equidistant from the outer surface and contains at least one opening by, in accordance, with the invention, using a coconut endocarp as the housing. The thickness of the endocarp may slightly vary as it is a natural coconut.

The claimed invention provides technical results comprising improvement of acoustic signal quality due to lower levels of parasitic acoustic resonances, excited, by the loudspeaker in the housing at the same time as the useful signal is generated by the loudspeaker membrane, as well as higher mechanical resistance of the housing side to pressure Changes that occur during operation of loudspeaker, due to the fact that the coconut endocarp has orthotropic properties, its inner and outer surfaces do not contain ribs, and it is a natural spheroid (ellipsoid or ovaloid of revolution) with walls of fibrous structure with mostly longitudinal orientation, and provides elimination of parasitic acoustic resonances during acoustic wave generation by vibrating membrane, as well as high mechanical strength at minimal wall thickness, characteristic of coconut endocarps, while simultaneously reducing mass and site of such an acoustic system.

The present invention provides for an acoustic system, comprising a coconut endocarp, the endocarp being a round shape, the endocarp further comprising one opening for installation of a loudspeaker, wherein the opening is formed by two individual cuts, the first cut being a circular cutout performed as the coconut endocarp rotates about the endocarp's longitudinal axis, the first cut forming, a first flat surface exposing fibers of an endocarp membrane, the second cut being a flat cross sectional cut, the second cut forming an adjacent fiat edge at an angle relative to the first flat surface, the two cuts creating a direct contact with the fibers of the endocarp membrane To this, a loudspeaker is positioned flush against the endocarp such that parasitic acoustic resonances generated from one or more sides of the loudspeaker are directed to a dampening channel for a dissipation of undesired frequencies.

In some aspects, the angle relative to the first fiat surface is 90 degrees. In some aspects, an exterior of the coconut endocarp is first processed to form a symmetric spheroid, ellipsoid, or ovaloid. In some aspects, the system further comprises a hermetic seal between the loudspeaker and the endocarp, the hermetic seal comprising a glue, epoxy, or another non-invasive adhesive. In some aspects, the coconut endocarp is first washed and dried. In some aspects, the coconut endocarp has been treated with a preservative material or substance to prevent biological damage. In some aspects, the coconut endocarp material is dyed. In some aspects, an interior of the endocarp is polished. In some aspects, the system further comprises at least one additional opening in the endocarp. In some aspects, the system further comprises an electronics unit placed inside the endocarp's cavity. In some aspects, the system further comprises sound absorbing material. In some aspects, the system further comprises a phase inverter. In some aspects, the system further comprises a protective mesh or cloth cover over the opening. In some aspects, the system further comprises fasteners anchored within the endocarp. In some aspects, the system further comprises a magnetic levitation system.

The present invention also provides for a method of making a loudspeaker housing, comprising making a first rotary cut into one longitudinal end of a coconut endocarp, removing a copra from an inner cavity of the endocarp, making a second flat cross sectional cut at the same longitudinal end of the endocarp, where the second cut forms a flat edge of the endocarp, and wherein the first cut and the second cut form a point having a predetermined angle, the predetermined angle being, the relative angle between a first surface formed b the first cut and a second surface formed by the second cut, wherein a loudspeaker is positioned flush against the first and second surfaces, such that parasitic acoustic resonances generated from one or more sides of the loudspeaker are directed to a dampening channel for a dissipation of undesired frequencies.

In some aspects, the first cut is made using a rotary lathe. In some aspects, the predetermined angle is 90 degrees, in some aspects, the method further comprises inserting a glue between the loudspeaker and the endocarp, where the glue (or other adhesive) forms a hermetic seal. In some aspects, the method further comprises processing the coconut endocarp prior to making the first cut, the processing comprising standardizing the coconut endocarp to form a symmetric spheroid, ellipsoid, or ovaloid.

The aforementioned results are confirmed by acoustic measurements of the claimed acoustic system created in accordance with the invention claims.

Figure 3:
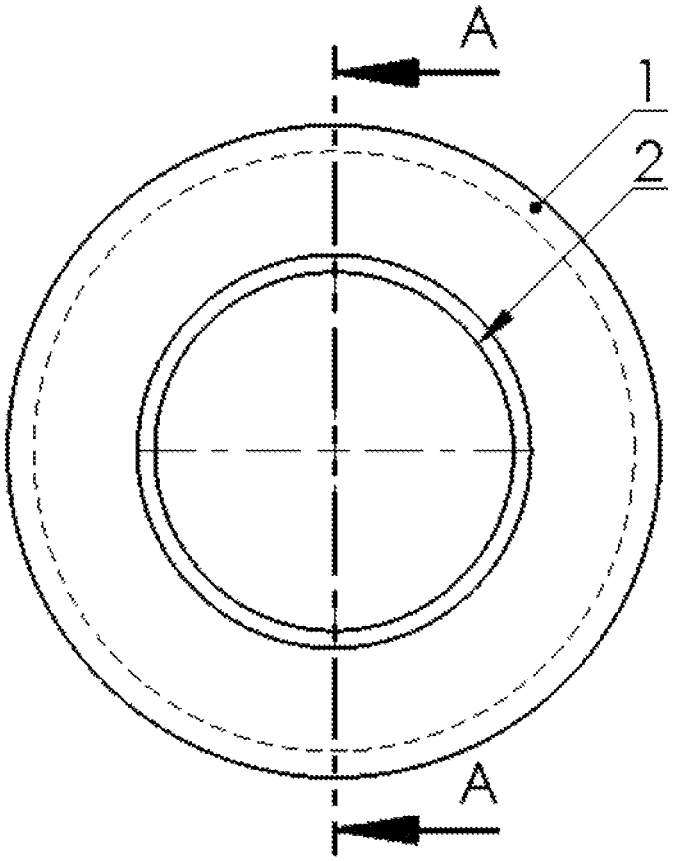

The proposed acoustic system is illustrated using diagrams, which are shown in:

FIG. 3—front view of acoustic system.

Figure 1:
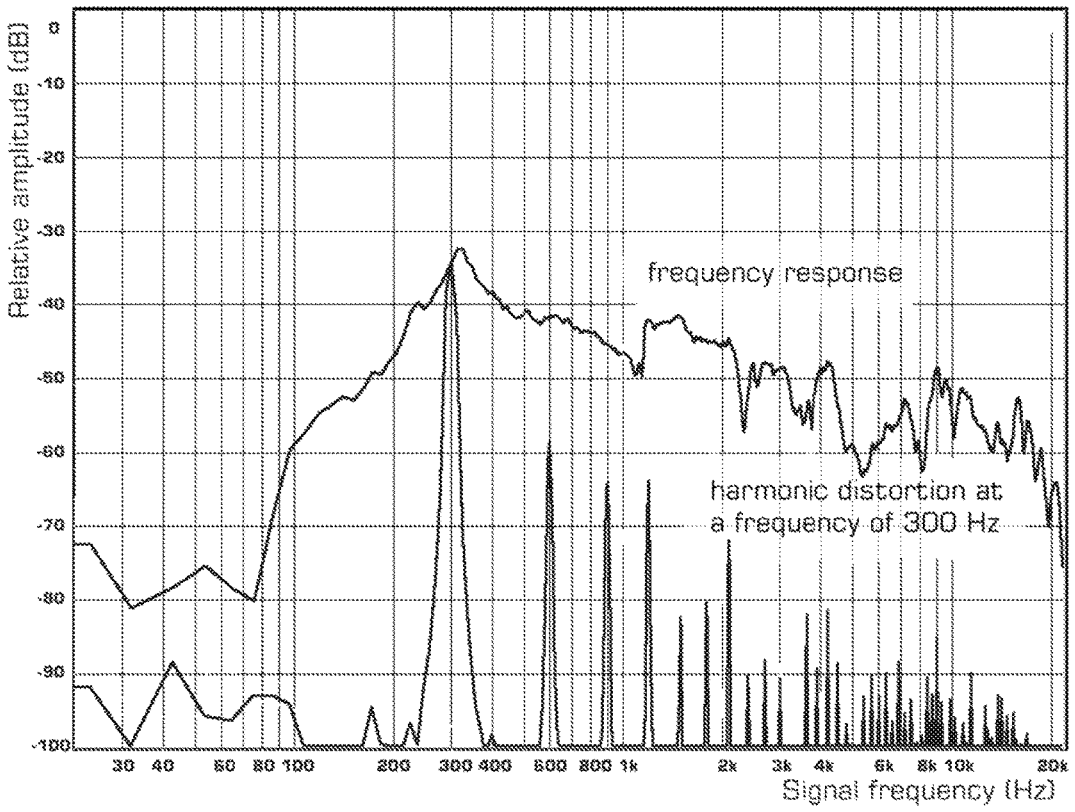
FIG. 1 shows a diagram of the amplitude-frequency characteristic (AFC) and harmonic distortions for the Genius SP-P100 test device.
Figure 4:
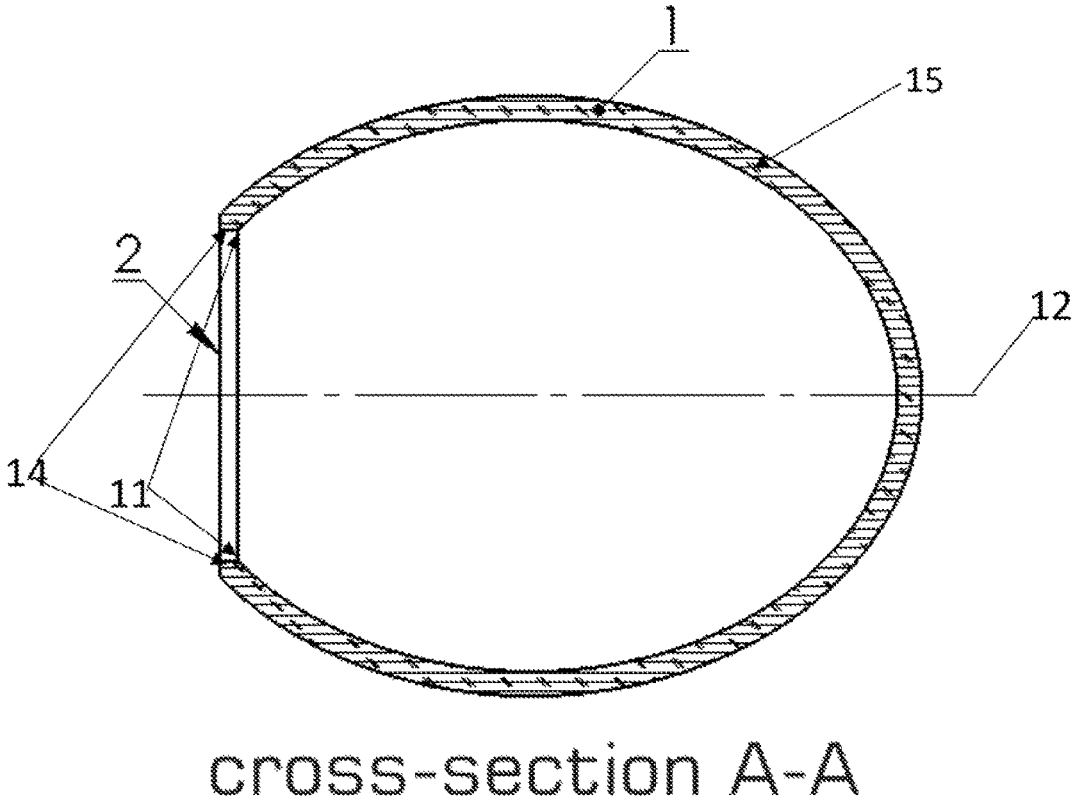

FIG. 4—cross-section A-A of FIG. 1.

Figure 5:
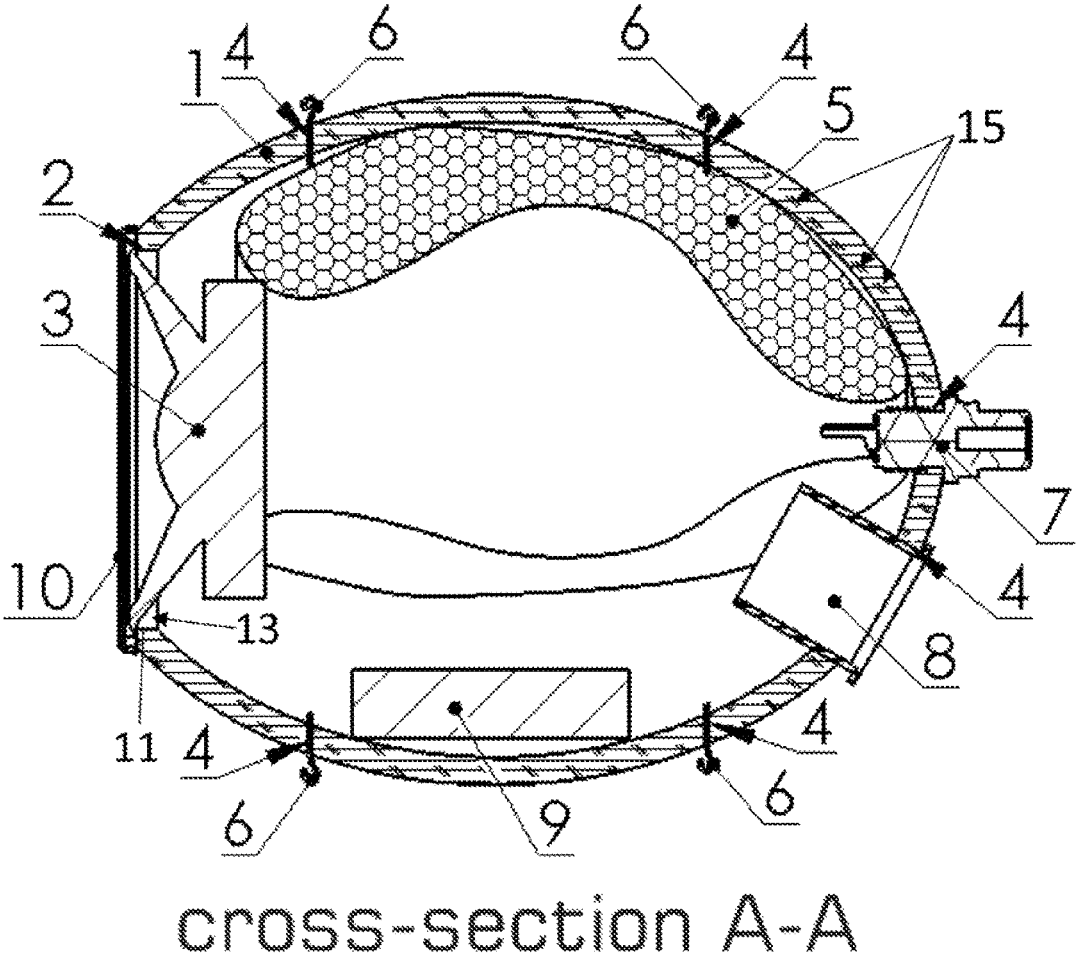

FIG. 5—cross-section A-A of FIG. 1 assembled acoustic system.

Figure 6:
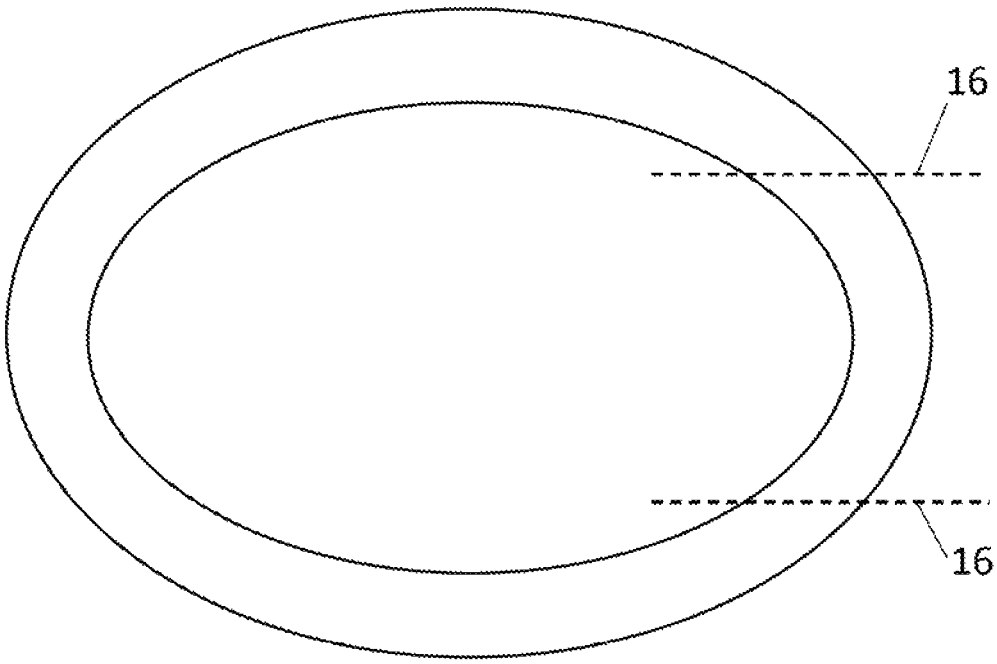

The proposed method for creating a housing for a loudspeaker is illustrated using diagrams, which are shown in:

FIG. 6—side view or one example of the first cut performed in the 2-cut process described herein. The cut is performed using a lathe or similar tool.

Figure 7:
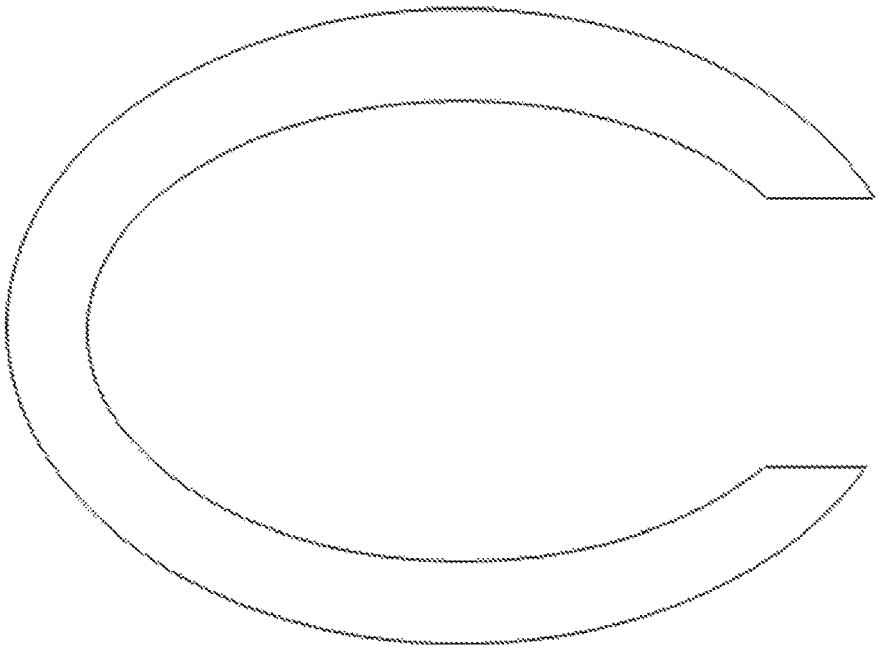

FIG. 7—side view of one example of the result of the first cut of the 2-cut process.

Figure 8:
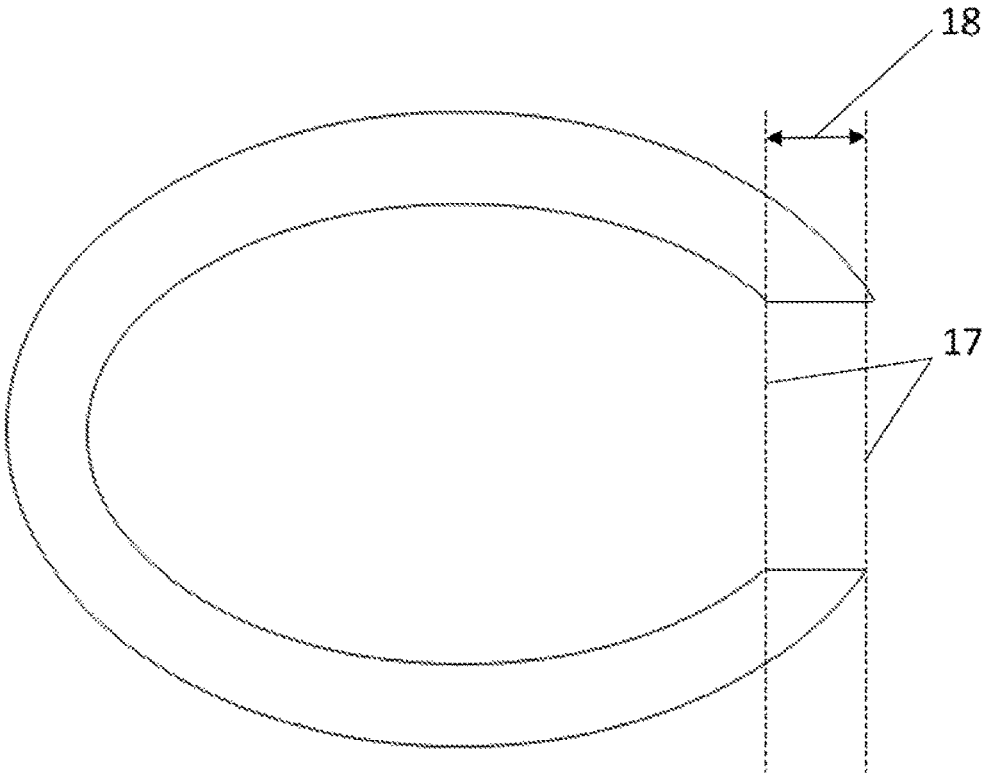

FIG. 8—side view of one example of the second cut of the 2-cut process described herein. It should be noted that the second cut may be made at any position at or between the broken lines shown in this figure. The position of the second cut will be determined based on the shape of the connecting portion of the desired loudspeaker to be coupled to the endocarp housing.

DETAILED DESCRIPTION OF PREFERRED EMBODIMENTS

Definitions.

"Membrane," or "endocarp membrane," as used herein, is defined as only the portion of the coconut comprising the endocarp of the coconut and the structure(s) that is (are) located between the inner lining of the endocarp and the outer lining of the endocarp.

"Fiber(s)," as used herein, is defined as the elements located in and making up the inner structure of the endocarp membrane. The fibers of the membrane are one of the elements which create the dampening effect of unwanted signals, as described hereinbelow.

"Dampening channel," as used herein, is defined as the channel formed inside the endocarp membrane, the channel being filled with fibers which are naturally located inside coconut endocarps. Sound waves travel through the dampening channel and the negative effects of those sound waves are minimized due to them being able to travel along and inside the endocarp membrane. Unwanted sound waves enter the membrane and remain inside the membrane due to the particular method of manufacturing and/or connecting the system as described herein.

Figure 2:
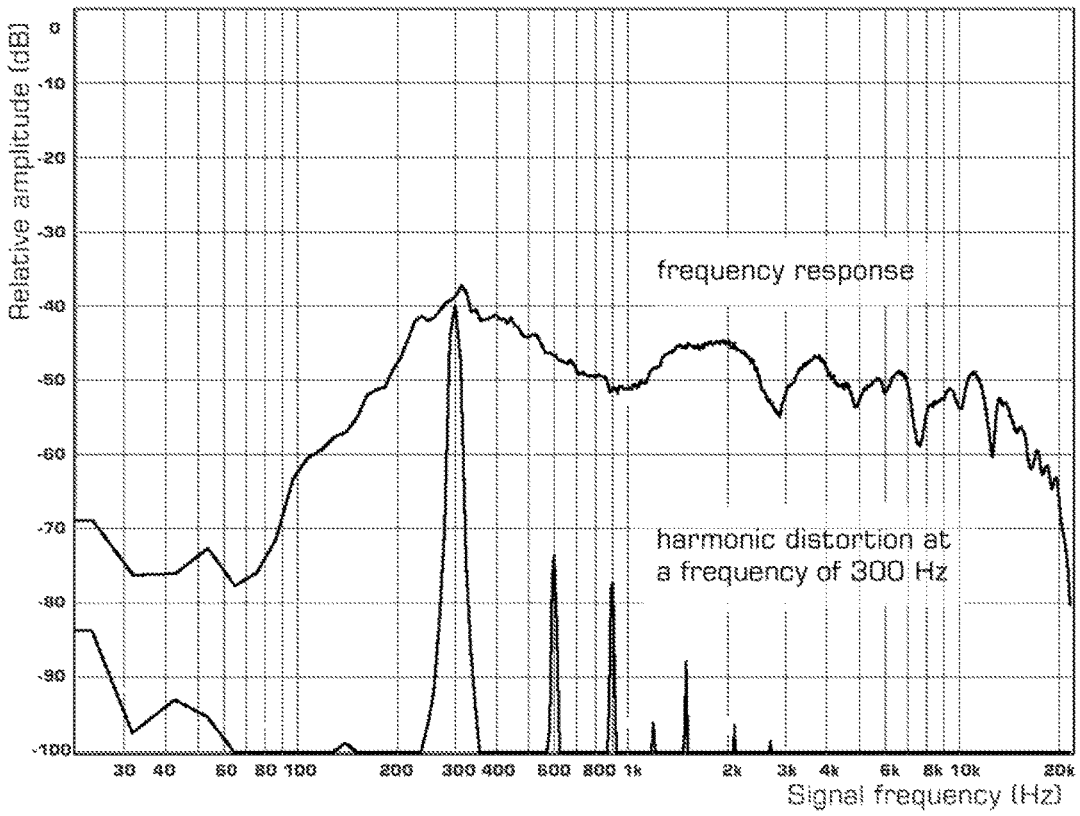
FIG. 2 shows a diagram of AFC and harmonic distortions of the claimed acoustic system with the Alphard FTP 66-1 loudspeaker.

Both devices in FIGS. 1 and 2 were connected to an outer reference amplifier using test tones of 300 Hz as most revealing from the perspective of parasitic vibrations in the housing. Measurements were conducted in a space with localized sound absorption in the near field (0.1 m) by the measurement microphone Behringer ECM8000.

Based on diagrams shown in FIG. 1 and FIG. 2, it follows that operation of the loudspeaker Alphard ETP 66-1 in the acoustic design of the claimed invention, similar to the Genius SP-P100 test device loudspeaker, are characterized by much lower levels of harmonic distortions.

The choice to use loudspeaker Alphard ETP 66-1 and Genius SP-P100 system for comparative tests was made, as the qualitatively most revealing, since both used speaker drivers of similar quality and the difference in levels of nonlinear harmonic distortions was caused foremost by vibration of the plastic housing. Greater measurement accuracy requires specialized equipment and specialists, which, might influence only the quantitative, not the qualitative, side of comparative measurements and does not change the essence of the claimed invention.

The proposed acoustic system shown in FIG. 3-5 comprises housing 1 made from coconut endocarp, the endocarp comprising fibers 1 and contacts at least one primary opening 2 for mounting the loudspeaker 3 and can also contains secondary openings 4 for cables and/or connectors for connection to a signal source (not shown in figures). The system may further comprise sound-absorbing material 5, fastening elements 6 (e.g., books for mounting with use of a flexible cord, or any other fastening elements), connectors 7, phase inverter 8, electronics unit 9, and protective mesh or cloth 10.

The proposed acoustic system is manufactured as follows.

The coconut chosen for producing the acoustic system housing 1 has the exocarp (outer shell) removed, it also may have a few natural openings (i.e., "germination pores"), and the liquid fraction is poured out. As shown in FIG. 5, the opening formed far positioning the loudspeaker is smaller than the widest portion of the loudspeaker, so that the loudspeaker (namely, the ring part 13 of the loudspeaker) may be positioned flush against the outer portion 14 of the cut in the endocarp, and in particular, flush against the inner portion 11 of the cut in the endocarp. No sealant is required because the connection is taut between loudspeaker and the opening (sealant can be used if desired, as described hereinbelow). When the loudspeaker is positioned in this manner, the parasitic acoustic resonances created by the side (i.e. the outer part) of the loudspeaker are most optimally eliminated because they are in direct contact with and dissipated along the inner structure and surface of the endocarp membrane. As seen in FIGS. 4-7, the first cut made to form the opening create an opening in the endocarp, the opening having a plane that is exactly perpendicular to the housing's longitudinal axis—this longitudinal axis is depicted as the horizontal line 12 in FIG. 4). The first rotary sectional cut 16 is made into one longitudinal end of the endocarp (e.g., with a rotating lathe or similar tool used for rotating either the endocarp or the tool used for cutting), wherein the diameter of the cut is less than or equal to the diameter of the outer part of the subsequently installed electroacoustic transducer (loudspeaker) 3, after which the copra is removed from the inner cavity. A second cut 17 is then performed on the endocarp. The second cut (depicted as the dotted line 17 in FIG. 8) is employed to create a flat edge of the housing, and further to form a point having a predetermined/desired angle between the flat edge of the exposed fibers inside the endocarp membrane and the fiat outer edge of the endocarp. For example, the angle can be a right angle, which would require the first and second cuts to be made in directions perpendicular to each other. In this example, the first cut 14 would be made as shown in FIG. 6, using a circular lathe or similar tool, creating a structure as shown in FIG. 7. Then, the second cut 17 would be made as shown in FIG. 8, and can be made anywhere in the area shown by the arrow 18 in FIG. 9. Such a method of performing cuts creates a right angle and also exposes as much surface area of the fibers of the endocarp as possible. This allows for the loudspeaker to be positioned comfortably and flush against the fibers and to be in contact with the maximum amount of fibrous surface area, causing an optimal amount of dampening of unwanted sounds/frequencies through a dampening channel, formed by the endocarp membrane and its fibers. It should be noted that the angle formed by the two cuts does not need to be a right angle (i.e. 90 degrees), and that a point having any angle may be created in order to fit a loudspeaker having particular or unusual crevices, shapes, designs, etc. The endocarp, after being processed in this manner, is then washed and dried. Inner and/or outer surfaces of the endocarp can be treated to prevent damage of a biological nature with corresponding preservation treatments and materials commonly used for this purpose.

The coconut is further processed to be made into the same shape as all other endocarps being used as housing for the system of the present invention. Such processing comprises forming the endocarp, however slightly, to a standardized shape. Since coconuts are naturally growing asymmetrical structures, no two coconut shells will be the same in shape, however slight. The standardized shape (e.g., a spheroid, ovaloid, ellipsoid, etc.), which all shells are processed to match, is calculated from a model which predicts the shape that will cause the lowest amount of unwanted interference and sounds. By processing the housing to form standardized shapes, the present invention further optimizes the sound produced by the loudspeaker and housing in combination. The housing is made to be rounded, uniform, smooth, and polished, at least on the exterior, and in some embodiments also on the interior of the housing.

In addition to both processing steps above, the endocarp surface may be dyed, saturated, and/or coated with some materials and/or substances which would provide the required protective properties and/or create an attractive appearances In addition to being attractive, aesthetically pleasing, etc., this additional processing of the endocarp surface further benefits the acoustomechanical properties of the housing by ensuring that the housing is entirely round such that no unwanted interference occurs between signals travelling in and/or through the endocarp housing. Afterwards, additional openings 4 can be made in the housing 1, if necessary, and all elements and materials traditionally used fur the aforementioned purposes may also be installed. For example, as shown in FIG. 5: sound-absorbing and/or dampening material 5, fastening elements 6, connectors 7 connected to the signal source (not shown in FIG.), phase inverter 8, electronics unit 9, protective decorative mesh or cloth 10, and if necessary, an autonomous power source not shown in FIG.) can be installed.

Furthermore, the present invention makes no use and in fact suggests not using an screws, bolts, etc. in connecting the housing to the loudspeaker (or vice versa). Any additional protrusion created in the endocarp or loudspeaker, as would be required by a screw, etc., worse the quality of the sound produced by the system. The membrane of the endocarp must remain in as much tact as possible and have as few protrusions (if any) as possible; hence the use of glue or another non-invasive adhesive, or another known non-invasive coupling method, is suggested to permanently connect the loudspeaker to the endocarp. Moreover, the glue or other adhesive acts as an additional flush surface between the endocarp and loudspeaker material, filling any additional openings or holes that might accidentally exist along that connection, such that no air pockets exist, or at least a minimum amount of air pockets exist. Screws, bolts, etc., would not solve this problem and create an additional issue of unnecessary protrusions in and along the surface of the housing. The glue or other adhesive, in contrast enhances the acoustomechanical properties of the present invention while also creating a tighter and hermetic seal than currently possible.

Dampening channel formed by creating optimal access and maximum surface contact with the fibers of the inner structure of the endocarp. The dampening channel is accessed and made available by making two cuts of the endocarp—the first cut is made using a rotating lathe or other similar rotary machine, which forms a circular cutout of the coconut shell (the cutout is discarded to create an opening for installation of the loudspeaker), and the second cut is a flush cut made at an angle relative to the first cut and in order to create an adjacent flat surface (the adjacent flat surface allows a portion of the loudspeaker to lay exactly flush against the interior of the endocarp membrane). In one embodiment, the two cuts form a right angle at the inside edge of the endocarp (i.e. where the inside of the shell meets the opening into the dampening channel (i.e. the interior of the endocarp membrane).

The proposed acoustic system operates as follows.

When supplying an electrical signal from the source (not shown in FIG.) to the loudspeaker 3 via either a wired connection, for example using a connector 7, which can also supply electrical power to the acoustic system, or via a wireless connection, for example, using the electronic unit 9, the membrane fluctuations create two acoustic waves that are in antiphase: one wave is emitted from the front side of the loudspeaker 3 membrane and freely spreads out into the surrounding space, while the acoustic wave from the opposite side of the loudspeaker 3 membrane is either absorbed into the housing using sound-absorbing material or brought out into the surrounding space in inverted phase via a phase inverter 8. Regardless of the method for eliminating an acoustic short circuit, i.e. when both antiphase acoustic waves interfere freely in space, the housing 1 provides the necessary hardness to minimize negative processes, namely—parasitic acoustic resonances and acoustic wave reemission into the surrounding space during housing pulsation and vibration due to properties of the coconut endocarp and its natural round form (spheroid, ovaloid, or ellipsoid) simultaneously provides minimization of diffraction phenomena that occur during propagation of acoustic waves around the housing 1.

The front of the loudspeaker 3 contains protective sound-transparent material 10, which also gives the acoustic system an appropriate outer appearance. The entire acoustic system may be housed in an enclosure, leaving the protective sound-transparent material 10 exposed, for aesthetic or mounting purposes (not shown in figures).

It will be understood that the system and method may be embodied in other specific forms without departing from the spirit or central characteristics thereof. The present examples and embodiments, therefore, are to be considered in all respects as illustrative and not restrictive, and the system method is not to be limited to the details given herein.

While the foregoing written description and examples of the invention enables one of ordinary skill to make and use what is considered presently to be the best mode thereof, those of ordinary skill will understand and appreciate the existence of variations, combinations, and equivalents of the specific embodiment, and examples herein. The invention should therefore not be limited by the above described embodiment, and examples, but by all embodiments within the scope and spirit of the invention.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is unless specified otherwise, or clear from context, "X employs A or B" is intended to mean any of the natural inclusive permutations. That is, if X employs A; X employs B; or X employs both A and B, then "X employs A or B" is satisfied wider any of the foregoing instances. In addition, the articles "a" and "an" as used in this application and the appended claims should generally be construed to mean "one or more" unless specified otherwise or clear from context to be directed to a singular form.

What is claimed is:

1. An acoustic system, comprising:

a coconut endocarp, said endocarp being a round shape, said endocarp further comprising one opening for installation of a loudspeaker, wherein the opening is formed by two individual cuts, the first cut being a circular cutout performed as the coconut endocarp rotates about the endocarp's longitudinal axis, the first cut forming a first flat surface exposing fibers of an endocarp membrane, the second cut being a flat cross sectional cut made adjacent to said first cut, the second cut forming an adjacent flat edge at an angle relative to the first flat surface, the two cuts creating a direct contact with fibers of the endocarp membrane, the cuts combining to maximize a surface area of exposed fibers of the endocarp, wherein a loudspeaker is positioned flush against the endocarp such that parasitic acoustic resonances generated from one or more sides of the loudspeaker are directed to a dampening channel for a dissipation of undesired frequencies.

2. The acoustic system of claim 1, wherein the angle relative to the first flat surface is 90 degrees.

3. The acoustic system of claim 1, wherein an exterior of the coconut endocarp is first processed to form a symmetric spheroid, ellipsoid, or ovaloid.

4. The acoustic system of claim 1, further comprising a hermetic seal between the loudspeaker and the endocarp, the hermetic seal comprising a glue.

5. The acoustic system of claim 1, wherein the coconut endocarp is first washed and dried.

6. The acoustic system of claim 5, wherein the coconut endocarp has been treated with a preservative material or substance to prevent biological damage.

7. The acoustic system of claim 1, wherein the coconut endocarp material is dyed.

8. The acoustic system of claim 1, wherein an interior of the endocarp is polished.

9. The acoustic system of claim 1, further comprising at least one additional opening in the endocarp.

10. The acoustic system of claim 1, further comprising an electronics unit placed inside the endocarp's cavity.

11. The acoustic system of claim 1, further comprising sound absorbing material.

12. The acoustic system of claim 1, further comprising a phase inverter.

13. The acoustic system of claim 1, further comprising a protective mesh or cloth cover over the opening.

14. The acoustic system of claim 1, further comprising fasteners anchored within the endocarp.

15. The acoustic system of claim 1, further comprising a magnetic levitation system.

16. A method of making a loudspeaker housing, comprising:

making a first rotary cut into one longitudinal end of a coconut endocarp, removing a copra from an inner cavity of the endocarp, making a second flat cross sectional cut at the same longitudinal end of the endocarp, said second cut forming a flat edge of the endocarp, wherein said first cut and said second cut form a point having a predetermined angle, said predetermined angle being the relative angle between a first surface formed by the first cut and a second surface formed by the second cut, said first and second surfaces being adjacent to one another, the combination of said first and second surfaces maximizing a surface area of exposed fibers of the endocarp, wherein a loudspeaker is positioned flush against the first and second surfaces, such that parasitic acoustic resonances generated from one or more sides of the loudspeaker are directed to a dampening channel for a dissipation of undesired frequencies.

17. The method of claim 16, wherein the first cut is made using a rotary lathe.

18. The method of claim 16, wherein the predetermined angle is 90 degrees.

19. The method of claim 16, further comprising inserting a glue between said loudspeaker and said endocarp, said glue forming a hermetic seal.

20. The method of claim 16, further comprising processing the coconut endocarp prior to making the first cut, said processing comprising standardizing the coconut endocarp to form a symmetric spheroid, ellipsoid, or ovaloid.

* * * * *